US005368110A

United States Patent [19]

French

[11] Patent Number: 5,368,110

[45] Date of Patent: Nov. 29, 1994

[54] DOWNHOLE ROTARY BEARING SUB

[75] Inventor: Michael R. French, Houston, Tex.

[73] Assignee: Texaco Inc., White Plains, N.Y.

[21] Appl. No.: 142,562

[22] Filed: Oct. 28, 1993

[51] Int. Cl.[5] ..... E21B 10/36; E21B 17/046

[52] U.S. Cl. ..... 175/57; 175/321; 175/415; 464/162

[58] Field of Search ..... 175/57, 320, 321, 415, 175/417; 464/162

[56] References Cited

U.S. PATENT DOCUMENTS 4,862,976 9/1989 Meek ..... 175/321 X

*Primary Examiner*—William P. Neuder

*Attorney, Agent, or Firm*—James L. Bailey; Kenneth R. Priem; Russell J. Egan

[57] ABSTRACT

A rotary bearing downhole sub has an outer housing adapted to be connected to an upper drill string and to receive therein an inner mandril adapted to be connected to a lower drill string. Both the outer housing and the inner mandril are provided with radially directed splines which, when brought into meshed engagement, allow transmission of rotary motion between the upper and lower drill strings and through the sub.

18 Claims, 4 Drawing Sheets

DOWNHOLE ROTARY BEARING SUB

BACKGROUND OF THE INVENTION

1. The Field of the Invention

The present invention relates to a tool to be used as a component in a drill string and, in particular, to a tool having axial thrust bearings, capable of withstanding compressive loads; radial bearings, to insure that torque is not transmitted across the sub when in the rotary configuration; and means to selectively permit transmission of torque across the sub.

2. Background of the Invention

When non-buckled pipe is moved in the axial direction along a straight inclined well bore, there is an axial friction force that opposes movement of the pipe. This friction force is referred to as "gravity drag". The magnitude of this drag is determined by multiplying the normal force acting against the hole wall by an axial coefficient of friction. This normal force is the weight of the pipe multiplied by the sine of the hole inclination. In other words, it is the normal component of gravity. The higher the hole inclination, the higher the normal force.

When pipe is moved in the axial direction along a curved section of the well bore, there is an additional axial frictional force that must be considered. A curved section of a well bore is commonly referred to as a "dogleg". When pipe subjected to an axial load (either tensile or compressive), is in a section of the well bore where a dogleg exists, there is an additional normal force acting against the hole wall. This will be referred as a "dogleg normal force". The magnitude of the dogleg normal force is proportional to the magnitude of the pipe axial load (force). There is an axial frictional force associated with this dogleg normal force when the pipe is moving in the axial direction. This additional force, or dogleg frictional force, is determined by multiplying the dogleg normal force by the axial coefficient of friction.

When a compressive load on an element of pipe exceeds a critical buckling load, the pipe buckles. This buckling action produces a force normal to the hole wall. The magnitude of the buckling normal force is proportional to the square of the axial force acting on the pipe. There is also an axial frictional force associated with this buckling normal force when the pipe is moving in the axial direction. This buckling frictional force is determined by multiplying the buckling normal force by the axial coefficient of friction.

The buckling frictional force is often overlooked. This force can be substantial in the vertical section of the hole where the critical buckling loads are minimal. It is actually possible for the buckling frictional force to equal the gravity axial force. When this occurs, it is no longer possible to transmit weight downhole. In effect, the pipe in the hole becomes locked. Slacking off additional pipe weight will only result in the pipe stacking up above the section where the pipe is locked due to the magnitude of the buckling frictional force.

In a curved well bore, the total frictional force opposing the movement of pipe is determined by adding the gravitational frictional force to the dogleg frictional force and the buckling frictional force. It is this total frictional force that is commonly referred to as "drag". All three of these individual frictional forces (gravity, dogleg and buckling), are directly proportional to the axial coefficient of friction. Thus the drag is directly proportional to the axial coefficient of friction.

When lowering pipe into a well bore, the total drag force described above works in the opposite direction of the axial component of gravity. This axial component of gravity is referred to as the "axial gravity force". The axial gravity force is the weight of the pipe multiplied by the cosine of the hole inclination. The higher the hole inclination, the lower the axial component of gravity.

A critical angle exists where the total drag force is equal to the axial gravity force. Pipe being lowered into a well bore will not slide down the hole under its own weight if it is in a section of the well bore where the inclination is greater than the critical angle. A compressive force is required to push the pipe into sections of the well bore where the inclination is above the critical angle. The critical angle is a function of the axial coefficient of friction.

When non-buckled pipe is being lowered into a straight inclined well bore, the total drag force is equivalent to the gravity drag force. In this situation the critical hole angle is plus or minus 72°, assuming an average axial coefficient of friction of 0.33. In this case, all pipe lowered into the hole at inclinations above 72° would have to be pushed into the hole. With a higher friction factor, the critical hole angle would be less than 72°.

If pipe is being lowered into a curved well bore, the critical hole angle is even less than that of a straight well bore, due to the dogleg frictional force. The higher the axial load on the pipe, the higher the dogleg frictional force and the lower the critical angle. In horizontal wells with long horizontal sections and/or in high angle extended reach wells, it is possible for the critical angle to actually be in the vertical section of the wellbore (at 0° inclination).

In order to lower pipe into the well, the axial gravity force associated with the pipe at inclinations less than the critical angle must exceed the drag forces associated with the pipe at inclinations above the critical angle. In directional wells, axial drag forces increase as the horizontal displacement from the drilling location increases. Horizontal displacement can be significantly limited in shallow horizontal and/or extended reach wells, since the axial gravity force available to push pipe into the hole is limited by the depth of the well.

The maximum achievable horizontal displacement in extended reach and/or horizontal wells can be increased by lowering the drag (axial component of friction). This can be done by decreasing the axial coefficient of friction. The axial coefficient of friction may be reduced by spotting a lubricating agent in the wellbore. Another means of reducing the axial coefficient of friction would be by rotating the pipe in the hole. This latter means is an effective solution of the problem, since the axial coefficient of friction is minimal as long as the pipe is rotating in the hole.

However, sometimes it is not desirable to rotate certain components of a drillstring. These components are typically located in the lower section of the drillstring. For example, a mud motor cannot be rotated during a course correction run or the tool face orientation will be lost. It is also often undesirable to rotate the drillstring when running a liner in an extended reach well, since the torsional stress might exceed the torsional yield of the connections on the liner. The axial drag could still be reduced in these situations, if a means existed to rotate the upper section of the drillstring without rotating the lower section of the drillstring. The present invention addresses and provides a unique solution for this problem.

The subject downhole rotary bearing sub includes means for rotating the pipe above the sub without rotating the pipe below the sub. By rotating the pipe above the sub, the axial coefficient of friction acting upon this upper section of pipe will be minimal and thus the axial drag forces will also be minimal. The pipe below the sub will not be rotated while being run in the hole and will not be subject to torsional loads. This pipe, however, will be subject to normal axial frictional forces.

SUMMARY OF THE INVENTION

The subject downhole rotary bearing sub has an outer housing with a box connector formed at its upper end and a profiled throughbore. An inner mandril is received in the lower end of the bore with a pin connector portion formed on its lower end extending from the outer housing. Both radial and axial thrust bearings are mounted between the outer housing and inner mandril which have unlimited relative rotational movement and limited relative axial movement. The outer housing has an array of inwardly directed splines and the inner mandril has an array of outwardly directed splines adapted to mesh with the splines of the outer housing when aligned therewith. The splines are engaged and disengaged by selectively placing the drill string under either tension (engaged) or compression (disengaged). A piston assembly selectively acts upon the inner mandril to lock it axially with respect to the outer housing when the splines are engaged in order to allow torque transmission between the outer housing and inner mandril if the sub is placed in compression subsequent to engagement of the splines. Means are also included to assure correct orientation of the inner mandril and outer housing when engaging the splines.

BRIEF DESCRIPTION OF THE DRAWINGS

The present invention will now be described, by way of example, with reference to the accompanying drawings in which.

DETAILED DESCRIPTION OF THE PREFERRED EMBODIMENT

Figure 1:
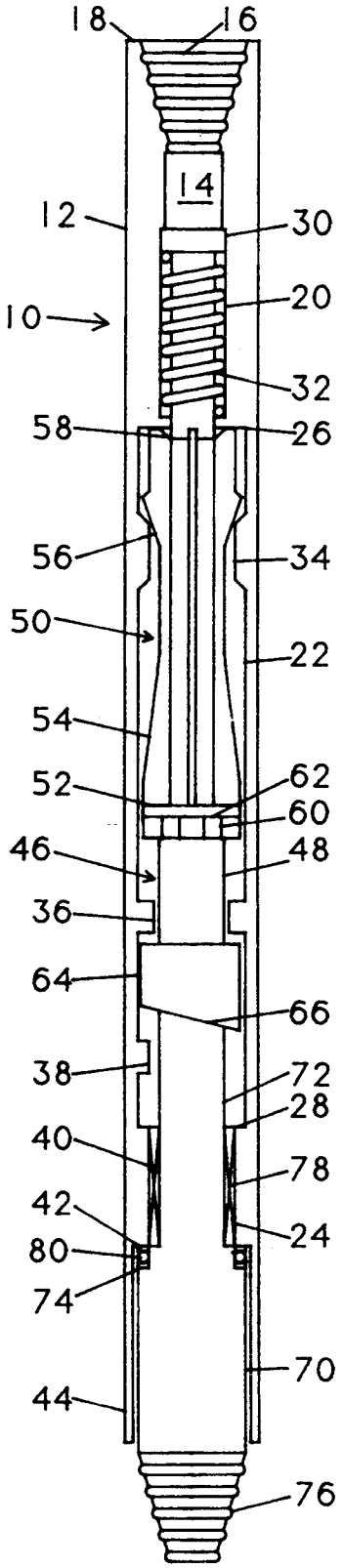
FIG. 1 is a side elevational view, partially in longitudinal section, showing a downhole rotary bearing sub according to the present invention in a rotary mode with the drill string in compression, the pumps off, and the latching mechanism inactive so that the sub is in an unlocked condition.
Figure 5:
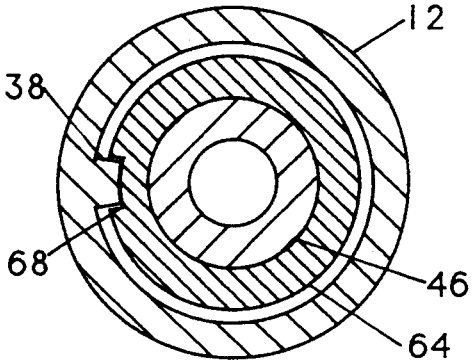
FIG. 5 is a transverse section taken along line 5—5 of FIG. 3.
Figure 6:
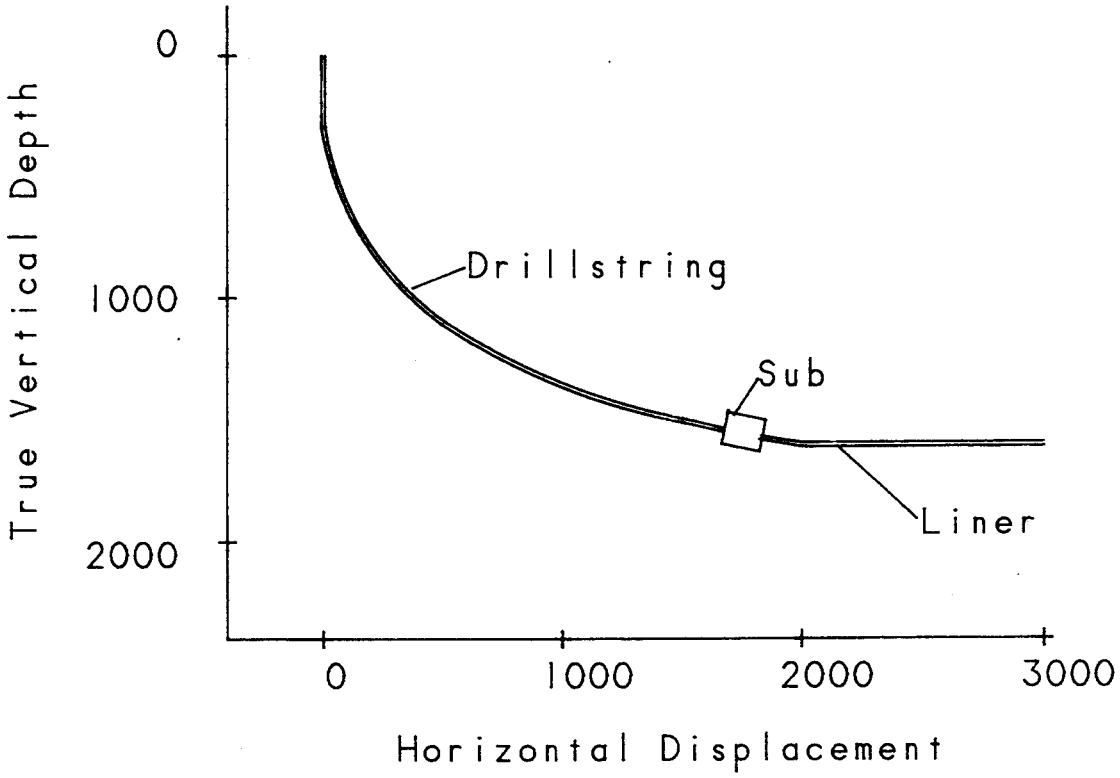
FIG. 6 is a diagrammatic side elevation showing the present invention as it would be used in running a liner.
Figure 7:
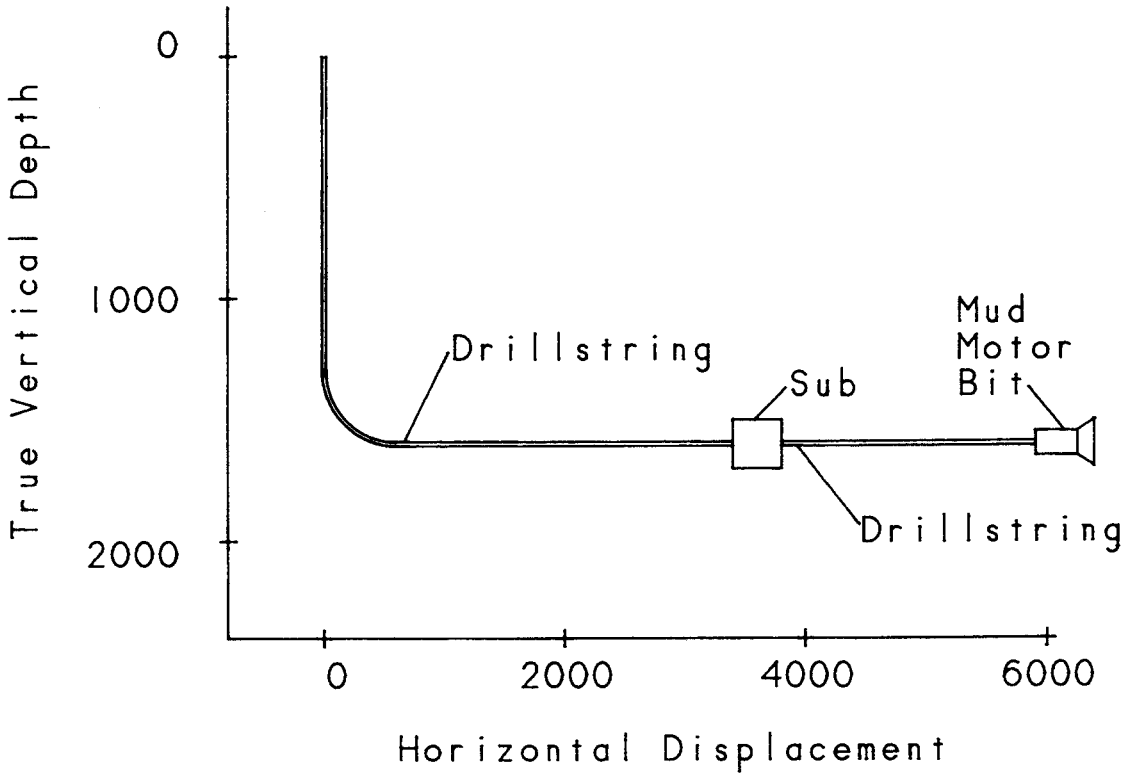
FIG. 7 is a diagrammatic side elevation, similar to FIG. 6, showing the subject invention as it would be used in an oriented mud motor drilling application.

The subject downhole rotary bearing sub 10 has a generally cylindrical, elongated outer housing member 12 with a profiled axial through bore 14. A known box connection 16 is formed on a first or upper end 18 and opens into the bore 14. The bore 14 forms a series of chambers, the first, or upper most, being piston chamber 20, the second mandril chamber 22, and the third bearing chamber 24, the chambers being separated by upper and lower shoulders 26 and 28, respectively. An annular piston 30 is received in the piston chamber 20 with spring 32 biasing the piston to the unlatched position, as shown in FIG. 1. The mandril chamber 22 has an inwardly directed annular lip or profiled cam surface 34 spaced from the upper shoulder 26 and a plurality of radially inwardly directed splines 36 spaced intermediate its ends. An orienting key 38 is fixed projecting radially into the mandril chamber between the splines 36 and lower shoulder 28. The bearing chamber 24 has an annular radial bearing surface 40, an axial thrust bearing shoulder 42 and terminates in an annular skirt 44. An inner mandril 46 is received in the mandril chamber 22 and has generally cylindrical main body member 48 with a collet assembly 50 attached to and extending from the upper end 52 of body member 48 toward the piston 30. The collet assembly 50 includes a plurality of like members 54 in a circular array, each with an outwardly directed profiled surface 56 adapted to interact with the annular lip 34 and an upper end surface 58 adapted to interact with piston 30. The upper end 52 of the main body member 48 also has a plurality of radially outwardly directed spline grooves 60 shaped and spaced to mesh with the splines 36 of the outer housing 12. The upper ends of the spline grooves 60 form a shoulder 62 which, by engaging with the splines 36 of the outer housing, limits the relative movement between the outer housing 12 and inner mandril 46. A muleshoe guide 64 is fixed to the mandril body member 48 spaced below splines 60 and includes an inclined surface 66 directed to a longitudinally extending groove 68 (see FIGS. 3 and 5), which receives therein the orienting key 38 on the outer housing 12. The lower end 70 of the inner mandril body member 48 forms a cylindrical bearing surface 72, an outwardly directed shoulder 74 and pin connector 76. Radial bearing 78 is mounted between bearing surface 40 of the outer housing 12 and bearing surface 72 of the inner mandril 46. Thrust bearing 80 is mounted on the shoulder 74 of the inner mandril and selectively engages shoulder 42 on the outer housing.

The box connector 16 of the outer housing 12 makes up with an upper drill string (not shown) while the pin connector 76 of the inner mandril 46 makes up with a lower drill string also not shown). Both connections are quite common and need not be discussed in any detail. The inner mandril 46 is capable of both unlimited rotational movement and restricted reciprocal axial travel within the profiled bore 14 of the outer housing 12. Axial thrust bearing 80, located between shoulders on the inner mandril 46 and outer housing 12, is capable of withstanding high axial loads and is designed to permit repeated separation and re-engagement of bearing surfaces. Roller type bearings have been illustrated for simplicity of the drawings, but most likely these thrust bearings would be fixed surfaces pressed into the respective shoulders. The radial bearings 78 insure that torque is not transmitted between the outer housing and the inner mandril when the sub is in the rotary configuration. The means for lubricating both bearings have not been shown, but are well known and could include bypassed mud or oil filled chambers.

The splines 36 on the outer housing and spline grooves 60 on the inner mandril are selectively engagable by application of tension or compression to the drill string. When engaged, the splines and spline grooves permit transmission of torque between the outer housing 12 and the inner mandril 46. When disengaged, the splines and spline grooves are sufficiently spaced apart so as to not inhibit relative rotation of the outer housing and inner mandril.

The splines 36 and spline grooves 60 are brought into proper orientation for meshed engagement by the fixed key 38 on the outer housing 12 engaging and following the inclined surface 66 of the muleshoe 64 carried by the inner mandril. Relative axial movement of the outer housing and the inner mandril brings the key 38 into engagement with the surface 66 prior to engagement of the splines 36 in the spline grooves 60. The key 38 rides along the surface 66 causing relative rotation of the outer housing and inner mandril until the key 38 is received in groove 68. The groove 68 in the muleshoe 64 is preferably axially aligned with one of the spline grooves 60 on the inner mandril while the key 38 is preferably axially aligned with a spline 36 of the outer housing. Thus the outer housing and inner mandril are brought into proper alignment for meshing of the splines and spline grooves.

Figure 2:
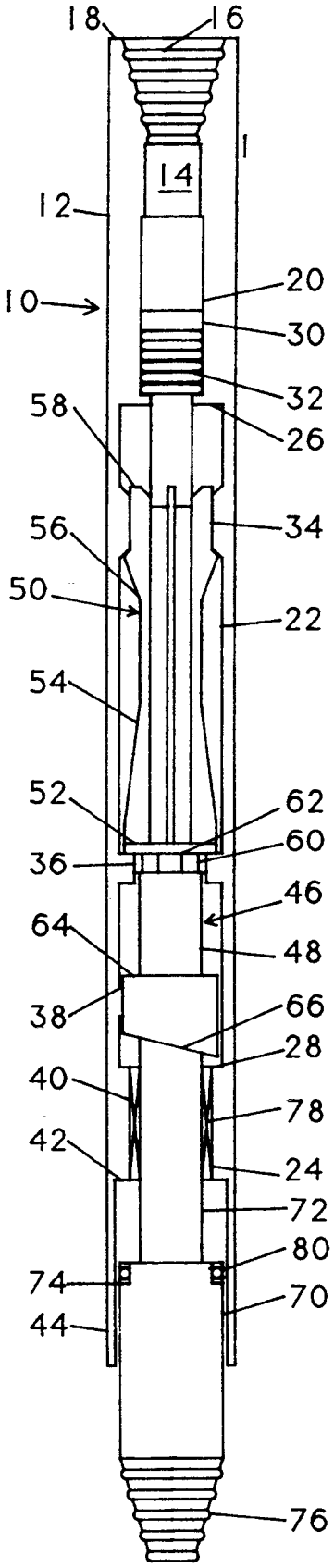
FIG. 2 is a similar side elevational showing the subject sub in a torque transmitting mode with the drill string in tension, the pumps on, and the latching mechanism active so that the sub is in a locked condition.
Figure 3:
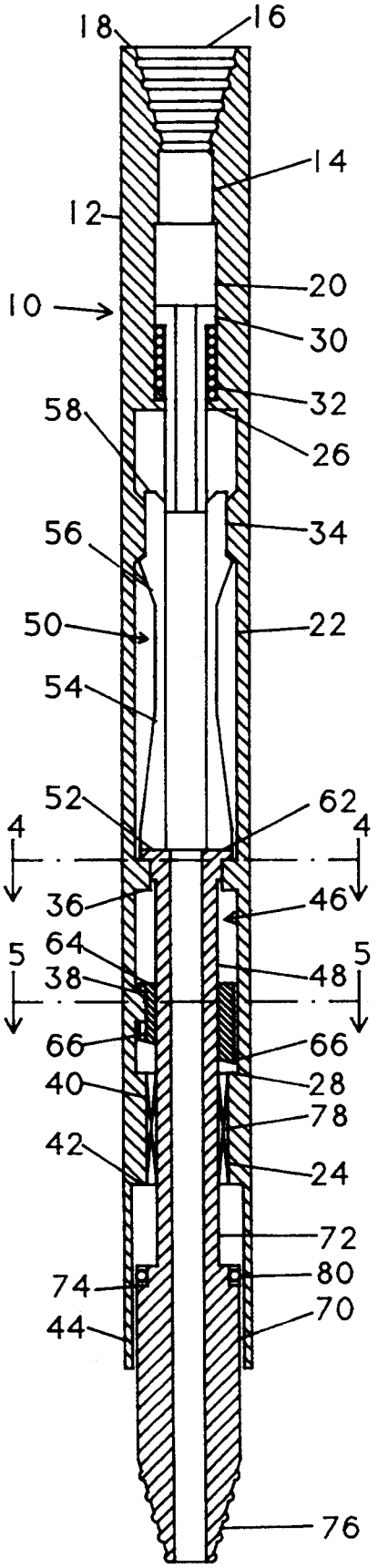
FIG. 3 is a side elevation similar to FIG. 2, but in full longitudinal section.
Figure 4:
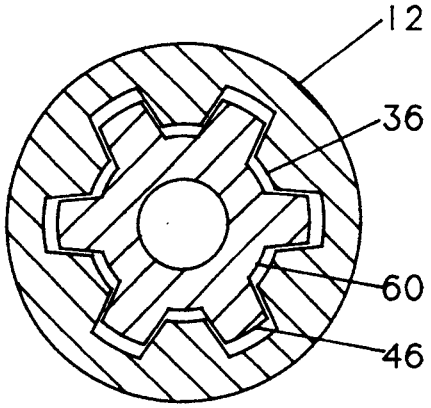
FIG. 4 is a transverse section taken along line 4—4 of FIG. 3.

The latching mechanism locks the splines and spline grooves in an engaged condition when the sub is placed in the torque transmitting mode (FIGS. 2 and 3) and subsequently exposed to compressive loads. The latching mechanism shown in the figures consists of the collapsible collet assembly 50 that is attached to the top 52 of the inner mandril 46 and the piston assembly 30, 32 and lip 34 of the outer housing. The outer surface 56 of each collet assembly member 54 is profiled to engage annular lip 34 on the outer housing 12. The piston 30, which is responsive to the fluid pressure of the system pumps (not shown) moves axially within the piston chamber 20 against the force of the biasing spring 32 to engage and lock the collet assembly, as shown in FIGS. 2 and 3. The piston 30 is activated when the mud flow rate through the sub exceeds a pre-determined rate. At flow rates above the pre-determined minimum, the net hydraulic force acting upon the piston 30 would exceed the opposing force created by the piston spring 32. When activated, the piston slides down to a position in which its lower end extends in between the upper ends 58 of the collet assembly members locking them in place. When the end of the piston is inside the collet assembly, the collet members 54 are no longer capable of collapsing inwardly and consequently the collet assembly 50 acts as a rigid body.

The sub is placed in the rotary mode (FIG. 1) by imposing a compressive load on the drillstring when the pumps are off, so that the above discussed hydraulically actuated latching mechanism is not activated. In this mode, compressive loads are transferred from the inner mandril 46 to the outer housing 12 via the shoulders 42 and 74 and the thrust bearings 80. When the sub is in a rotary mode (FIG. 1), the profiled surfaces 56 of the collet members 54 are above the lip 34 on the outer housing 12. When the latching mechanism is activated, the piston 30 extends in between the collet members and prevents the collet assembly from collapsing. This effectively "locks" the sub in the rotary mode, as long as the end of the piston 30 remains inside the collet assembly, even if the sub is subsequently placed in tension.

The sub is placed in the torque transmitting mode (FIG. 2) by imposing a tensile load on the drill string while the latching mechanism is not activated. This condition causes a relative movement of the outer housing and inner mandril bringing the splines into engagement with the spline grooves. This relative longitudinal movement is limited by engagement of the splines 36 on the outer housing 12 with the shoulder 62 of the spline grooves 60 of the inner mandril 46. Thus torsional loads can be transferred from the outer housing to the inner mandril via the splines on the outer housing engaging the spline grooves on the inner mandril. When the sub is locked in this torque transmitting mode, the profiled surfaces 56 of the collet members 54 are below the lip 34 on the outer housing. Should the latching mechanism then be activated, the end of the piston would extend in between the ends of the collet members to prevent the collet assembly from collapsing. As long as the piston is inside the end of the collet assembly, the sub will remain in a locked configuration, even if the sub is subsequently placed in compression.

The sub is configured for the rotary mode by imposing a compressive load on the sub prior to activating the hydraulic latching mechanism. In practice, this would be accomplished by first turning off the rig pumps, or reducing the fluid circulating rate below the minimum required to activate the latching mechanism. Next, sufficient drillstring weight would be slacked off to ensure the neutral point is above the sub (i.e. ensure the sub is in compression). Increasing the pump rate above the pre-determined minimum activates the latching mechanism and locks the sub in the rotary mode.

The sub is configured for the torque transmitting mode by creating a tensile load on the sub prior to activating the hydraulic latching mechanism. In practice this would be accomplished by first turning off the rig pumps, or reducing the circulating rate below the minimum required to activate the latching mechanism. Next, the sub would be placed in tension by picking the drillstring off bottom. When the sub is in the rotary mode, the splines on the outer housing and spline grooves on the inner mandril are free to move relative to one another. When the sub is placed in tension, it is necessary for the splines and spline grooves to be aligned to ensure proper engagement. The illustrated muleshoe orienting arrangement ensures this proper spline and spline groove engagement.

When the sub is placed in tension, the inner mandril will move axially downwardly relative to the outer housing. When the muleshoe surface 66 contacts the orienting key 36 on the outer housing, the inclined surface of the muleshoe 64 will force the inner mandril 46 to rotate within the outer housing 12. The inner mandril will rotate until the orienting key 36 slips into the key slot 68 on the muleshoe. In this position, the splines 36 on the outer housing are aligned with the spline grooves 60 on the inner mandril. A continued downward movement of the inner mandril (due to tensile loading) will engage the aligned splines and spline grooves and will be halted by shoulder 62 abutting the tops of splines 36.

As the inner mandril moves downward relative to the outer housing, the collet attached to the inner mandril moves downward also. The collet members ride over the outer housing lip causing the collet assembly to collapse inwardly and allows the inner mandril to continue it's downward movement until the splines and spline grooves are fully engaged. When the sub is in the locked configuration (splines fully engaged), the upper shoulder on the collapsible collet assembly will be in contact with the lower shoulder on the outer housing lip. The sub is then locked into this mode by increasing the pump rate above a pre-determined minimum flow rate. In this mode, both compressive loads and torque may be transmitted across the sub.

Means providing lubrication of the bearings, etc. and to actuate movement of the piston, for example, have not been shown for sake of simplifying the drawings. It is submitted that there are many known means for accomplishing these desired results and that they are well within the skills of one skilled in the art so that no detailed description is necessary.

The subject rotary bearing sub can be considered as being somewhat similar in nature and design to a bearing pack on a mud motor. The sub is provided with a thrust bearing, since the axial loads would be expected to be relatively high, and with radial bearings to insure that the torque generated at this sub is not transmitted to the pipe below the sub when in the rotary mode. The bearings could be lubricated by any known technique, such as mud circulation. The expected rotational speed of the sub would be fairly low so that heat dissipation requirements should also be low.

If the subject sub is run above a liner, then it preferably would be run immediately above a liner setting tool. This configuration would allow the use of an inner wash string.

If the subject sub is run within a liner string, it could be left in the hole with the liner. A sub that is to be left in the hole would probably differ slightly in design from one run above the liner. A wash string could still be used, but a rotating sub would be required for the wash string. This would be a simple sub requiring only radial bearings.

The present invention may be subject to many modifications and changes without departing from the spirit or essential characteristics thereof. The present embodiment should therefor be considered in all respects as illustrative and not restrictive of the scope of the invention as defined by the appended claims.

I claim:

1. A rotary bearing downhole sub comprising:

a generally cylindrical outer housing member having drill string attachment means on an upper end and defining a profiled axial bore and an array of inwardly directed spline means within said axial bore;

a generally cylindrical inner mandril member having drill string attachment means on a lower end and an upper end profiled to be received in said axial bore of said outer housing member for both relative rotational and axial movement, said inner mandril member having an axial bore and an array of outwardly directed spline grooves adapted to engage the spline means of said outer housing member;

bearing means mounted between said outer housing member and said inner mandril member; and latching means adapted to lock said outer housing member and said inner mandril in an engaged condition, whereby relative axial movement of said outer housing member and said inner mandril member engages and disengages said spline means and said spline grooves for the selective transmission of torque between said members.

2. A rotary bearing downhole sub according to claim 1 further comprising:

means to align said splines and spline grooves for meshed engagement.

3. A rotary bearing downhole sub according to claim 2 wherein said alignment means comprises:

a fixed stud on one of said members; and a inclined surface on the other of said members, said surface leading to a stud receiving groove, whereby engagement of said stud against said surface causes relative rotation of said members until said stud rests in said grove and said members are properly aligned.

4. A rotary bearing downhole sub according to claim 2 wherein said stud is fixed projecting radially inwardly from said axial bore of said outer housing member; and said included surface and groove are on a muleshoe fixed to said inner mandril.

5. A rotary bearing downhole sub according to claim 1 wherein said axial bore in said outer housing defines:

a upper piston chamber, an intermediate mandril chamber and a lower bearing chamber, and respective upper and lower annular shoulders separating said chambers.

6. A rotary bearing downhole sub according to claim 5 wherein said latching means comprises:

piston means movably mounted within said piston chamber of said outer housing member and adapted to engage said inner mandril member selectively locking it in position to prevent relative axial movement of said members or releasing said inner mandril member for relative axial movement within said outer housing member.

7. A rotary bearing downhole sub according to claim 6 further comprising:

collet assembly means mounted on and extending from said inner mandril member and adopted to be acted upon by said piston means; and cam means mounted in said axial bore of said outer housing member positioned to selectively engage said collet assembly means, whereby relative axial movement of said members moves said collet assembly with respect to said cam means and said piston means acts upon said collet assembly to lock said members in their relative axial position.

8. A rotary bearing downhole sub according to claim 1 wherein said drillstring attachment means of said outer housing is a box connector.

9. A rotary bearing downhole sub according to claim 1 wherein said drillstring connection means of said inner mandril is a pin connector.

10. A rotary bearing downhole sub according to claim 1 wherein said bearing means comprises:

axial thrust bearing means; and radial bearing means.

11. A rotary bearing downhole sub according to claim 5 wherein said bearing means are mounted in said bearing chamber engaging said outer housing member and said inner mandril member.

12. A rotary bearing downhole sub according to claim 1 further comprising:

means limiting the relative axial movement of said inner mandril member and said outer housing member.

13. A rotary bearing downhole sub according to claim 12 wherein said means to limit relative axial movement of said inner mandril member and said outer housing member comprises:

a shoulder formed on one end of said spline grooves limiting the movement of said splines therein in a first direction; and shoulder means on one of said members and abutment means on the other of said members limiting relative movement in the opposite direction.

14. A method of operating a rotary bearing downhole sub mounted between upper and lower drillstring segments for selectively transmitting forces between said segments, comprising the steps of:

providing a rotary bearing downhole sub having a generally elongated cylindrical outer housing member with a profiled axial bore and a box connector at its upper end, a generally elongated cylindrical inner mandril member with its upper end at least partially received in said axial bore of said outer housing member for relative axial and rotational movement thereto and with a pin connector on its lower end, bearing means between said members, means to lock said members against relative axial motion, and means to transmit torque between said members;

connecting said upper drillstring to said box connector;

connecting said lower drillstring to said pin connector;

acting on said drillstring to unlock said members so as to allow relative axial movement;

acting on said drill string to effect relative axial movement between said members to selectively engage or disengage said torque transmission means; and acting on said sub to lock said members against relative axial movement.

15. A method of operating a downhole rotary bearing sub according to claim 14 wherein said means to lock said members against relative rotation is responsive to well fluid pressure, comprising the step of:

controlling well fluid pressure to selectively lock and unlock said members.

16. A method of operating a downhole rotary bearing sub according to claim 15 wherein increasing said fluid pressure above a predetermined level causes locking of said members.

17. A method of operating a downhole rotary bearing sub according to claim 14 wherein said members are moved axially relative to one another by application of tension or compression on said drillstring, comprising the step of:

applying tension or compression to said drillstring to effect relative axial movement of said members to appropriately engage or disengage said torque transmission means.

18. A method of operating a downhole rotary bearing sub according to claim 17 wherein applying tension to said drillstring engages said torque transmission means.

* * * * *